US006113307A

United States Patent [19]

Joyner, III et al.

[11] Patent Number: 6,113,307

[45] Date of Patent: Sep. 5, 2000

[54] HIGHWAY DELINEATOR

[75] Inventors: Ernest Joyner, III, Hampton; Patrick J. Ladolcetta, Early Branch, both of S.C.

[73] Assignee: Carsonite International, Early Branch, S.C.

[21] Appl. No.: 09/075,737

[22] Filed: May 11, 1998

[51] Int. Cl.[7] ..... E01F 9/015; E01F 9/017

[52] U.S. Cl. ..... 404/10; 404/14; 116/63 R

[58] Field of Search ..... 404/9, 10, 11, 404/14; 116/63 R, 209; 40/606, 608, 612; 256/13.1

[56] References Cited

U.S. PATENT DOCUMENTS

| | | | |
|---|---|---|---|
| D. 337,131 | 7/1993 | Wilson . | |
| D. 362,818 | 10/1995 | Sandy . | |
| 1,726,817 | 9/1929 | Franklin . | |
| 3,502,007 | 3/1970 | Andersson . | |
| 3,705,566 | 12/1972 | Duckett et al. | 116/63 P |
| 3,851,615 | 12/1974 | Grundvig et al. . | |
| 4,078,867 | 3/1978 | Ronden . | |
| 4,092,081 | 5/1978 | Schmanski . | |
| 4,094,116 | 6/1978 | Gilb | 52/693 |
| 4,123,183 | 10/1978 | Ryan | 404/10 |
| 4,245,922 | 1/1981 | Auriemma . | |
| 4,343,567 | 8/1982 | Sarver . | |
| 4,515,499 | 5/1985 | Furiate | 404/6 |
| 4,522,530 | 6/1985 | Arthur . | |
| 4,779,955 | 10/1988 | Schmanski . | |
| 5,181,695 | 1/1993 | Arthur . | |
| 5,199,814 | 4/1993 | Clark et al. | 404/10 |
| 5,215,033 | 6/1993 | Gipp et al. | 116/209 |
| 5,483,917 | 1/1996 | Walker . | |
| 5,620,277 | 4/1997 | Cole, Sr. . | |

*Primary Examiner*—James A. Lisehora
*Attorney, Agent, or Firm*—Thorpe, North & Western, LLP

[57] ABSTRACT

A highway delineator device comprising an elongate tube having a bottom end, a top end, an inside surface, and an outside surface, and configured for use as a highway delineator. The bottom end of the tube comprises means for connecting the tube to a base support in such a manner that the tube is in a vertical configuration, and the top end of the tube having at least three different cross-sections comprising (i) a top cross-section flattened together with opposing inside surfaces sealed together to fully close the top end of the tube and having opposing outside surface in parallel relationship for receiving a top edge of reflective material without curvature, (ii) an intermediate cross-section having an elongate gap extending between the opposing inside surfaces, said outside surfaces along the gap being slightly arcuate to provide a flattened surface for receiving a lower section of reflective material with moderate curvature, and (iii) a lower cross-section having a circular configuration. The flattened portion of the top of the delineator further comprises a reflective marker attached to its outside surface.

26 Claims, 6 Drawing Sheets

HIGHWAY DELINEATOR

BACKGROUND OF THE INVENTION

1. Field of the Invention

This invention relates to delineators used for highway marking. More particularly, the present invention relates to an improved, tubular highway delineator which is flattened and fused together at the top such that rain water and debris may not enter the tube.

2. State of the Art

Highway construction and signage entail the installation and use of delineators to mark the edge of the safe roadway (see FIG. 2), to mark the location of nearby hazards, and to temporarily mark lane division stripes in construction zones or in areas with changeable lane configurations such as reversible commuter lanes or near toll collection booths (see FIG. 3). When properly placed, highway delineators help guide motorists and provide advance warning of potential hazards. Typical delineators comprise a post with a reflector attached near its top. The post is embedded in the highway embankment, or attached to a base fixture in the paved roadway or in the embankment, and is of a height such that it is visible by the ordinary driver from a safe distance, depending on the design speed and geometry of the particular section of roadway. An attached reflector allows the delineator to be visible at night or during low visibility times of the day. In locations where heavy snowfall is anticipated, highway delineators may be six or eight feet tall or more, to allow wintertime visibility when snow accumulation would cover a delineator of ordinary height.

In the past, delineator posts have been made of wood and metal. However, these can be a severe hazard when vehicles collide with them at higher speeds. Subsequent repair or replacement is costly, and also exposes maintenance personnel at risk with high speed traffic. More recently, impact resistant delineators made of lightweight polymers such as polyvinylchloride (pvc), polypropylene, and high density polyethylene (hdpe) have been used widely because they are inexpensive to manufacture, present less of a safety hazard, are easier and cheaper to transport, yet can still meet the design requirements highway designers demand. Composite posts of resin and fiber reinforcement have provided an additional category of delineators which incorporate column stiffness and lateral flexibility for impact. This wide variety of compositions and geometric shapes has produced a broad spectrum of delineator devices which are specifically designed for particular purposes.

One particular class of delineators referred to as high impact posts are positioned in congested traffic areas and are designed to take repeated impacts. These posts are generally made of softer plastics such as thermoplastic polymers. The primary design requirements of this class of highway delineators include sufficient strength to resist repeated buffeting forces of wind and recurring bumper and tire impacts in the locality of installation. In addition, they must be sufficiently durable to resist degradation due to sunlight, heat, cold, rain, snow, wind, salt, roadway oils, and other anticipated highway conditions.

High impact delineators are represented by the structure shown in FIGS. 1 and 2 depicting a conventional lightweight tubular highway delineator. It is comprised of a vertical, thermoplastic tube 20 that is embedded in a highway embankment 42, with a reflector 28 attached near its top. Alternatively, the bottom end of the delineator may be attached to a base fixture that is embedded in a highway or highway embankment, or is coupled to a ground-mounted base member 50 as shown in FIG. 3. Conventional highway delineators typically have a round or nearly round cross-section as depicted. A round cross-section is desirable because it provides uniform bending strength relative to transverse forces from any direction, and thus gives the delineator uniform resistance to wind from any direction. However, a round cross-section limits the visual aspect and surface exposure for reflective decals, making it less visible than desired. For example, a rounded surface reflects incident light back in all directions, resulting in a relatively small amount of light reflected back to a motorist from automobile headlights at night.

An additional problem associated with tubular delineators arises with the attachment of a reflective decal at an upper end of the tube. Those delineators which have been partially flattened at the upper end to provide the required surface exposure have often been capped with an elliptical cover designed to maintain the flattened shape. When the cap is removed by impact or vandalism, the restraining influence of that shape is lost, and the tube tends to restore toward its circular shape. This not only reduces the width of the exposed surface, often resulting in loss of compliance with specifications, but also weakens the bond of the reflective material. Specifically, as the curvature of the upper tube member shifts to a shorter radius, the reflector material tends to peal away from the outer tube surface. Further weathering can quickly degrade the reflector adhesive, resulting in ineffective reflection or even total separation of the reflector from the tube.

To provide greater visibility, some delineators 54 have been produced with a flat web section 56, as illustrated in FIG. 4. Flat delineators provide the advantages of high visibility and minimal potential collision hazard, but tend to be stiffer and have lower sheer strength. In high impact areas, the larger bending radius of the stiffer materials is subject to elastic failure, particularly with tire impacts.

To address this problem, tubular delineators 60 have been designed with a round cross-section 62 in their lower portion where high elastic stress are applied, with a flattened or oval or elliptical cross section 64 near the top. This combination provides enhanced impact response with the lower tubular design, but increased surface exposure in the region where the reflector 28 is attached. FIG. 5 depicts the top portion of typical delineators with an oval or elliptical cross-section 66 near the top. An oval or elliptical configuration has the advantage of providing a broader surface for attachment of the reflector, and also provides a broader aspect which makes the delineator more visible when it is installed with the flatter surface facing an on-coming driver.

However, these configurations still present several problems that have not been solved in the prior art. A simple tubular delineator, as depicted in FIGS. 5 and 6, whether circular or elliptical, is open at the top, allowing rain, snow, and debris to enter the tube. This can cause several problems. Rain or snow water that enters can freeze and burst the tube or dislodge it from its base. Debris or water that gets into the tube or from the tube into the base can also make temporary delineators difficult to install or remove. The accumulation of debris within the base of the tube tends to lessen the resilience of the tube after impact, and may increase the splitting or breaking of the tube in view of the particulate rock within the tube interior. Upon impact, such debris tends to fracture or split polymer material, greatly weakening its sheer strength and its resilience.

Some conventional tubular delineators attempt to solve these problems by placing a cap 68 over the top of the tube, as in FIG. 5. However, this solution has several disadvantages. The cap may fall off and become lost, thus not performing its intended function. This is particularly true with a vehicle impact, which usually rips the cap free from its mounted position. It also increases the manufacturing cost of the delineator, and introduces an additional maintenance expense.

Additionally, an oval or elliptical cross-section still does not provide the broadest aspect for reflectivity. A preferred delineator will incorporate the mechanical strength and resilience advantages of a circular or nearly circular cross section in its post, while providing the visibility advantages of a flat reflector, and preventing the introduction of water and debris into the tube. The following specific discussion on the prior art figures will assist the reader to appreciate the significance of the present invention.

FIG. 1 provides a front view of a typical highway delineator 20, which is generally comprised of an elongated tube 22, typically of circular cross-section as depicted, having a top end 24, and a bottom end 26, and a reflective marker 28 attached to the top of the tube. In a typical installation, the bottom end 26 is embedded into the ground some suitable distance 32 below the surface of the ground 30. In many conventional delineators, the top end 24 is somewhat flattened for some distance 29 from the top to create an oval or elliptical cross section, with the a reflective marker 28 attached to the flatter or broader side of the cross-section. This provides a larger visual aspect for the reflective marker 28.

FIG. 2 shows a roadway cross section depicting one typical installation of a highway delineator 20 alongside a roadway 34. In this installation the delineator 20 is located some distance 40 from the edge 37 of the traveled roadway 34, typically located near where the usable shoulder slope 38 transitions into the generally steeper roadway embankment 42. As in FIG. 1, the bottom end of the delineator is embedded some suitable distance 32 into the roadway embankment. FIG. 2 depicts this installation adjacent to a roadway 34 constructed with pavement 36, but delineators may also be used adjacent to unpaved roads.

FIG. 3 shows a surface mounted, alternative installation of a typical highway delineator 20 between lanes 46 of a roadway 44. In this installation, the delineators 20 are usually either connected to a suitable base support fixture at 50, or are inserted into holes in the pavement at the same location. The delineators are typically located in line with the lane stripes 48, and are situated some suitable distance 52 from each other. Reflective markers 28 may be attached to both front and back of the delineators 20, so as to be visible to traffic from both directions. One embodiment of the present invention defines a method of use of the described highway delineator which is compatible with the installations depicted in FIG. 2 and FIG. 3.

FIG. 4 shows a perspective view of the top of one type of conventional flat highway delineator 54. This type of delineator is typically comprised of a solid shaft 56 of thermoplastic material having a constant cross-section 58, with a reflector 28 attached to its flat face. Because of its broad aspect, thin cross-section, and soft polymer construction, this delineator is highly visible, but quite weak. Fiber reinforced, thermosetting materials may also be used in this configuration, and give enhanced stiffness; however, such composite delineators have a larger bending radius and are not as practical for high impact areas.

FIG. 5 shows a perspective view of the top of a conventional flattened tubular highway delineator 60 which is generally comprised of an elongated tube 62 which has a circular or other suitable cross-section in its lower end as shown. The top end, however, is flattened to an oval cross-section, 64 so as to allow a reflective marker 28 to be affixed to the broad face of the tube in the flattened region near its top. In some embodiments of this type of conventional delineator, the opening 66 in the top of the tube is covered by a cap 68, to prevent water or debris from getting inside the tube.

FIG. 6 shows an alternative perspective view of the top of a conventional elliptical highway delineator 70, that is fastened together by a mechanical fastener 78 at its topmost extreme. The cross section of the top part of the shaft 72 is typically oval or elliptical, as in the alternative of FIG. 5, and has a reflective marker 28 attached to its broad face. The lower portion of the tube 72 is typically of circular cross-section, as shown. The fastener 78 causes the cross-section at the top 74, to deform and change the opening 76 in the top of the tube into two separate openings 76'. This configuration still has the disadvantage of allowing water or debris to enter the top of the tube.

OBJECTS AND SUMMARY OF THE INVENTION

It is therefore an object of the present invention to provide a tubular highway delineator that is sealed at the top such that water and debris cannot enter the tube.

It is another object of this invention to provide a tubular highway delineator that does not require a separate attached part to prevent water and debris from entering the tube.

It is another object of this invention to provide a highway delineator that is flattened near the top such that it provides a maximum visual aspect to on-coming motorists.

It is yet another object of this invention to provide a highway delineator that combines the mechanical strength of a tubular cross-section for most of its length in order to effectively resist wind and other forces, but has a flattened cross-section in the vicinity of the reflector for maximum visibility.

It is a further object of the present invention to provide a highway delineator that is simple to manufacture and comprises a minimum of parts.

The above and other objects are realized in an apparatus comprising an elongate tube having a top end, an inside surface, and an outside surface, and configured for use as a highway delineator. The top end of the tube is flattened and opposing inside surfaces are fused or bonded together at the top. A reflective material is attached to the outside surface of the flattened portion of the tube. This configuration combines the lighter weight and strength advantages of a tubular cross-section with the visual aspect advantages of a flat cross-section. At the same time, it prevents water and debris from entering the tube, while avoiding the cost and potential hazard of a separate cap or similar piece attached to the top of the tube.

Some of the above objects are also realized in a method of manufacturing a tubular highway delineator comprising the steps of cutting an elongate tube to a length appropriate for a highway delineator, flattening the top end of the tube, and fusing the opposing inside surfaces of the flattened portion of the tube at the top. These and other objects are also realized in a method of delineating highways, comprising the steps of installing a tubular delineator as described above in a desired location on or near a highway or along power or utility lines, and orienting the reflective marker toward anticipated oncoming vehicular traffic.

Other objects and features of the present invention will be apparent to those skilled in the art, based on the following description, taken in combination with the accompanying drawings.

DETAILED DESCRIPTION OF THE PREFERRED EMBODIMENT

Figure 1:
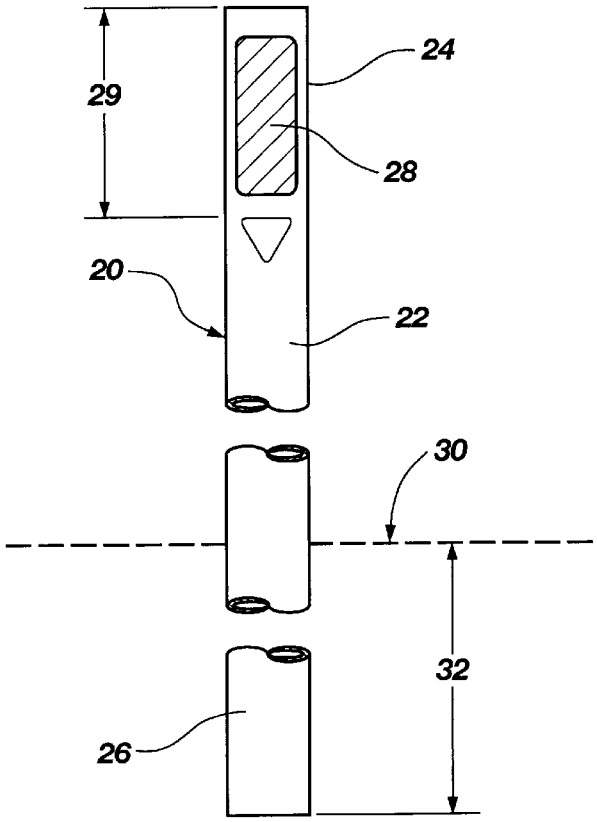
Fig. 1 (PRIOR ART)
FIG. 1 provides a front view of a typical highway delineator.
Figure 2:
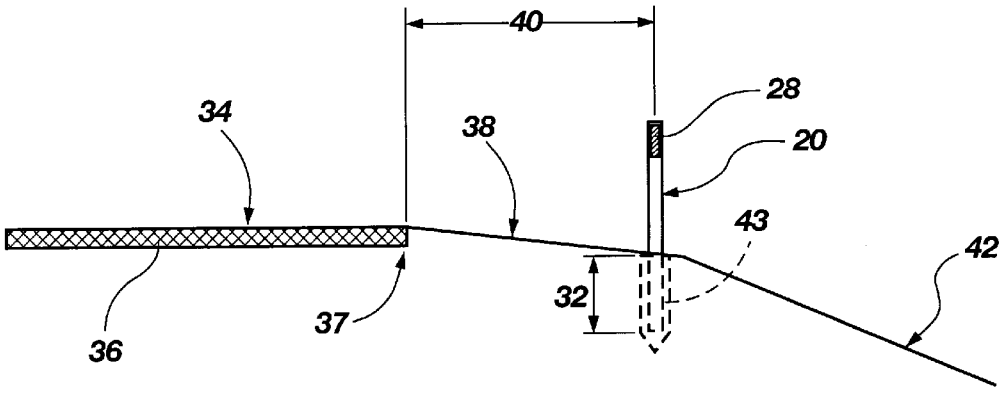
FIG. 2 shows one typical use of a highway delineator.
Figure 3:
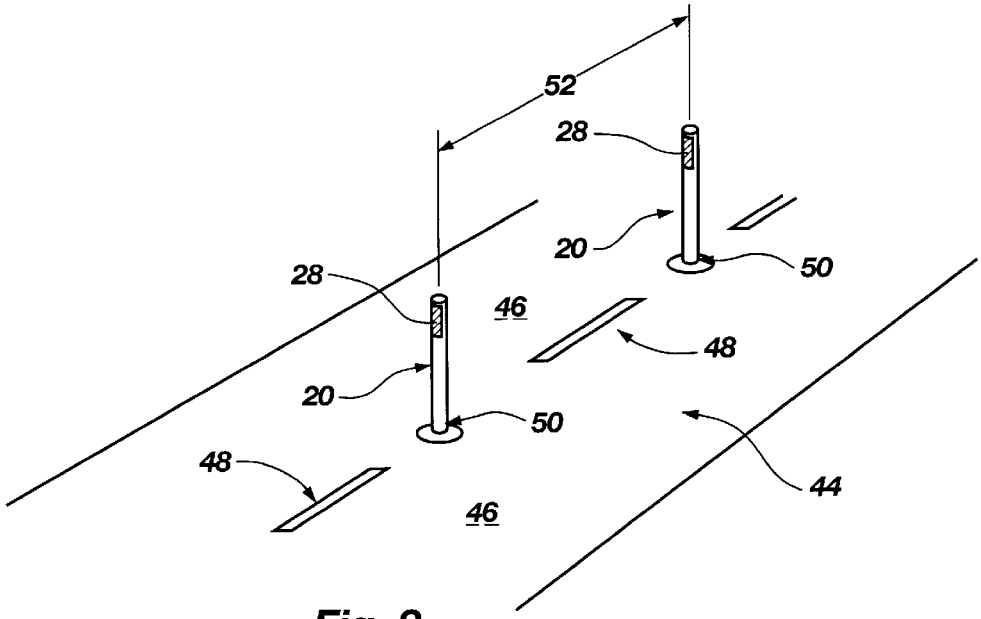
Fig. 3 (PRIOR ART)
FIG. 3 shows an alternative installation of a typical highway delineator.
Figure 4:
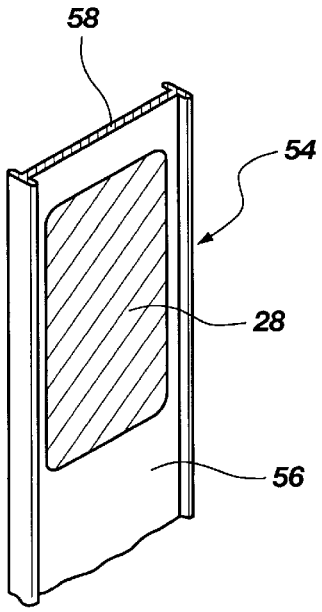
Fig. 4 (PRIOR ART)
FIG. 4 shows a perspective view of the top of a conventional flat highway delineator.
Figure 5:
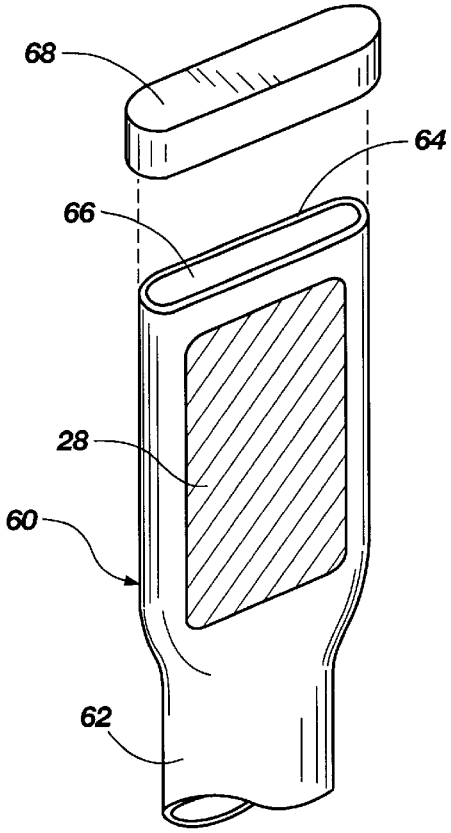
Fig. 5 (PRIOR ART)
FIG. 5 shows a perspective view of the top of a conventional flattened tube highway delineator.
Figure 6:
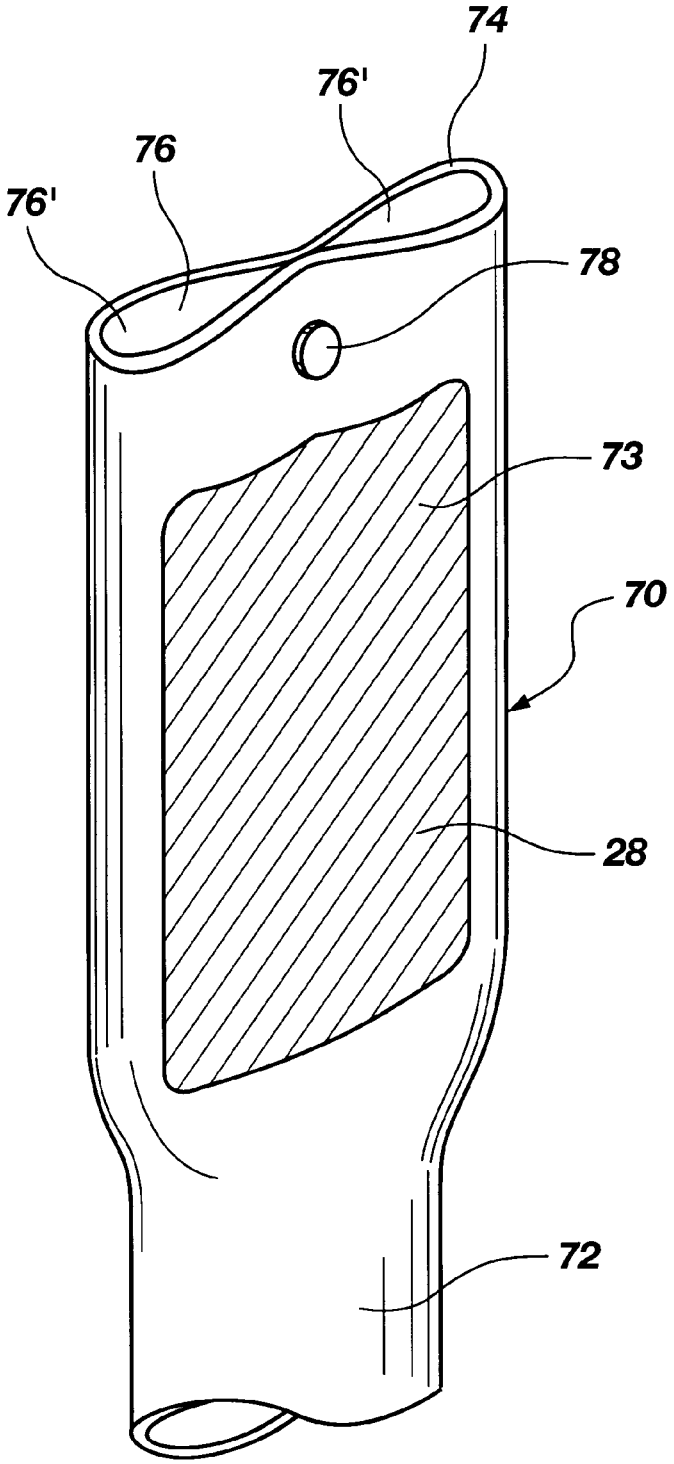
Fig. 6 (PRIOR ART)
FIG. 6 shows an alternative perspective view of the top of a conventional flattened tube highway delineator that is fastened together at its topmost extreme.
Figure 7:
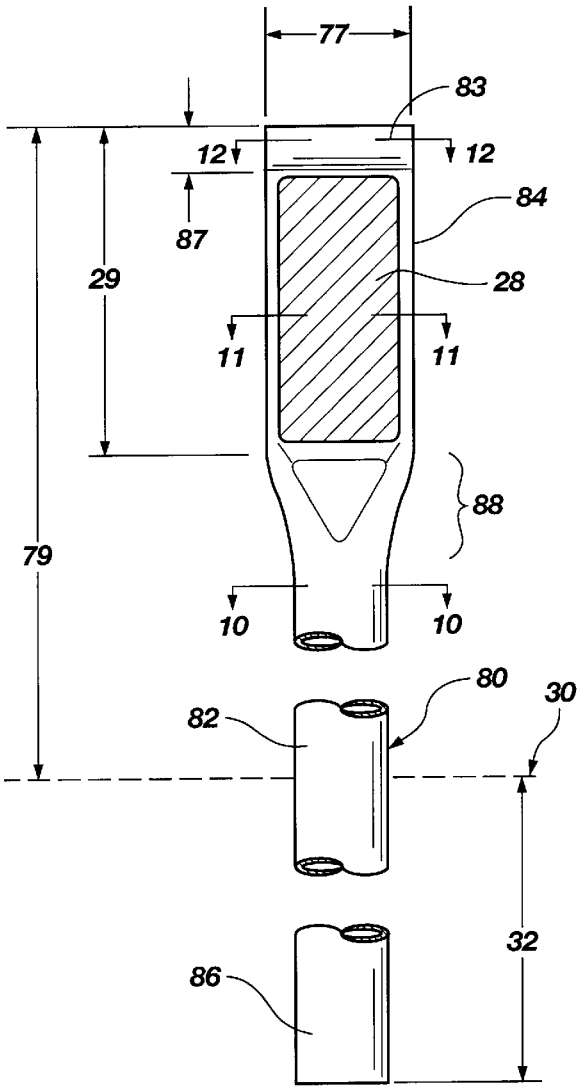
FIG. 7 provides a front view of a highway delineator incorporating one aspect of the principles of the present invention.

Referring now to the drawings:

FIG. 7 provides a front view of a highway delineator incorporating the principles of the present invention. The delineator 80 is generally comprised of a hollow tubular shaft 82, with a top 84 and a bottom 86. The tube 82 is of generally circular cross-section along its lower and intermediate length as shown at section A—A, with an upper section of flat or oval cross-section at section B—B, with a transition section 88 between the two regions. In the preferred embodiment the width 77 of the flattened section 84 is approximately 3.5", and the height 79 of the delineator above the ground is approximately 6'. In the preferred embodiment, the tube is made of polypropylene. However, there are other materials that can be used, including polyvinylchloride (pvc), high density polyethylene (hdpe), or other suitable polymers that do not degrade in sunlight.

In the embodiment of FIG. 7 the bottom 86 of the delineator 80 is typically embedded into the ground some suitable distance 32 below the ground surface 30. The top 84 of the delineator 80 is flattened for some distance 29 measured from its topmost extreme, with a reflector 28 attached to the flat face of the delineator. In the preferred embodiment the distance 29 may be in the range of 6" to 24", with 18" being preferred. Flattened lengths of more than 24" are possible, but as the flattened length 29 increases, the stiffness and resilience of the delineator 80 decrease.

The topmost portion 83 of the delineator is completely flattened with opposing inside surfaces fused together for some distance 87 measured from the topmost extreme of the delineator. In the preferred embodiment, the length 87 of the fused portion 83 is in the range of 1" to 12", with an approximate 1.5" length representing a balance between ease of fabrication and structural properties.

Figure 8:
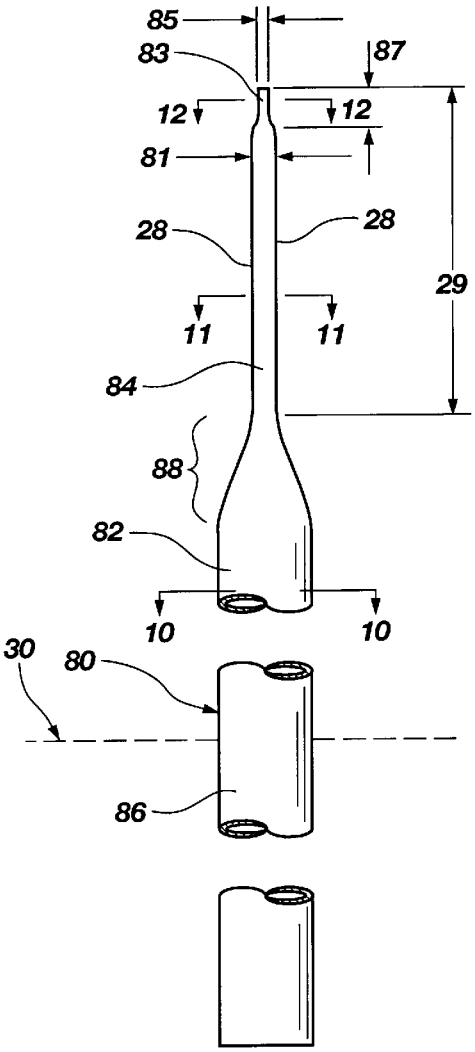
FIG. 8 provides a side view of the highway delineator represented in FIG. 7.

FIG. 8 provides a side view of the highway delineator of FIG. 7, incorporating the principles of the present invention. As in FIG. 7, the delineator 80 is generally comprised of a hollow tubular shaft 82, with a top 84 and a bottom 86. The tube 82 is of generally circular cross-section at section A—A, and is of a flat or oval cross-section of thickness 81 at section B—B, with a tapering transition section 88 between the two regions. The bottom 86 of the delineator 80 is embedded into the ground some suitable distance 32 below the ground surface 30. Such installation would include telescopic insertion of the bottom end 86 within a pipe 43 embedded within the ground 42. The top 84 of the delineator 80 is flattened for some distance 29 measured from its topmost extreme, with one or more reflectors 28 attached to the opposing front and/or back flat faces of the delineator.

The topmost portion 83 of the delineator is completely flattened to a thickness 85 approximately double the thickness of the wall of the tube 82. Opposing inside surfaces 94 are fused together 94' for some desired distance 87 measured from the topmost extreme of the delineator as specified in the description of FIG. 7. The thickness 81 of the flattened but unfused portion of the top 84 of the delineator will be greater than the thickness 85 of the fused portion. Both of these dimensions will vary depending on the thickness of the tube material. In the preferred embodiment the thickness 85 of the fused section is approximately 0.2 inches, and the thickness 81 of the flattened section is 0.4 inches.

Figure 9:
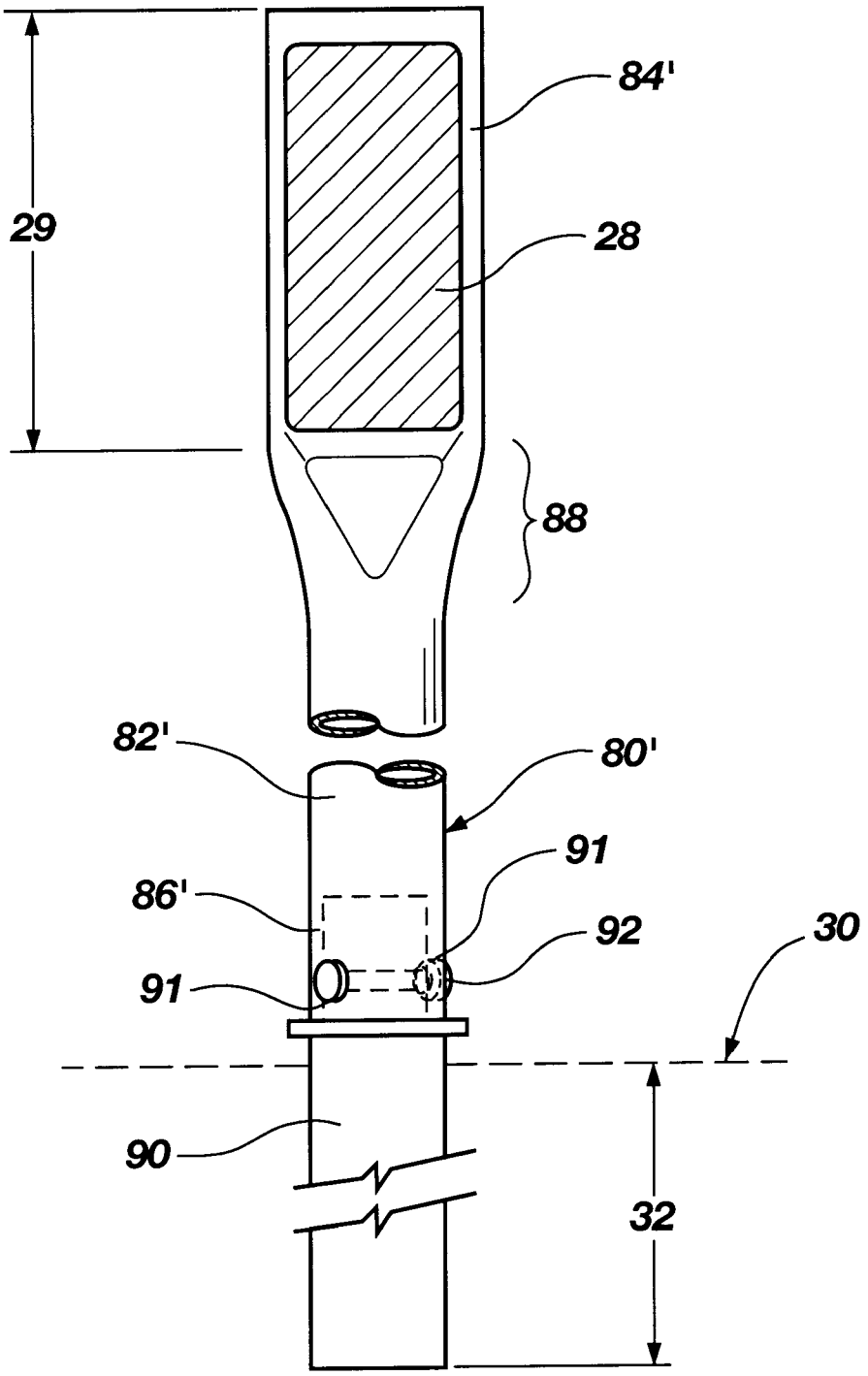
FIG. 9 provides a front view of a highway delineator incorporating another aspect of the principles of the present invention.

FIG. 9 provides a front view of a highway delineator incorporating an alternative embodiment of the principles of the present invention. The delineator 80' is generally comprised of a hollow tubular shaft 82', with a top 84' and a bottom 86'. In the embodiment of FIG. 9 the bottom 86' of the delineator 80' is mechanically fastened above the ground surface 30, to a base fixture 90, that is embedded into the ground some distance 32 below the ground surface 30. This type of installation frequently utilizes break-away base fixtures in order to reduce the hazard encountered when a vehicle collides with a fixed object such as a delineator post. The base fixture may use a nut and bolt assembly 92 passing through corresponding holes 91 in the base 90 and the bottom 86' of the delineator 80' in order to mechanically connect the components together, or any other suitable means of connection known in the art. As in the embodiment of FIG. 7, the top 84' of the delineator 80' is flattened for some distance 29 measured from its topmost extreme, with a reflector 28 attached to the flat face of the delineator.

Figure 10:
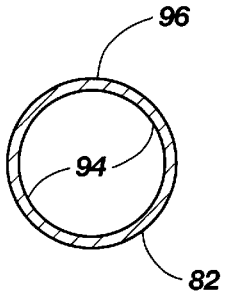
FIG. 10 shows a cross-sectional view of the round shaft of the highway delineator of FIG. 7 taken along line A—A.
Figure 11:
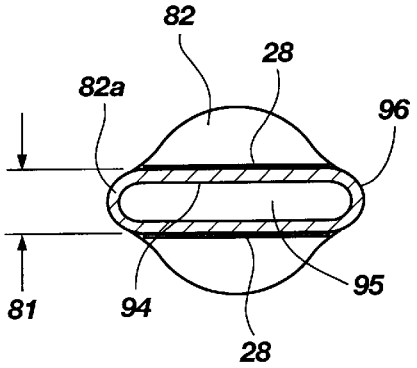
FIG. 11 shows a cross-sectional view near the top of the highway delineator of FIG. 7 taken along line B—B.

FIG. 10 shows a cross-sectional view of the shaft of the highway delineator of FIG. 7 taken along line A—A. At section A—A the tube 82 has a generally circular cross-section with an inside surface 94 and an outside surface 96. FIG. 11 shows a cross-sectional view of the top portion of the highway delineator of FIG. 7 taken along line B—B. At section B—B the top of the tube 82*a* has a flattened or oval cross-section of thickness 81, with an inside surface 94, an outside surface 96, and an inside space 95. Reflective markers 28 are attached to the substantially flat outside surfaces 96 of the tube. The outside surface of the circular portion 82 of the tube is visible beyond the section of FIG. 11.

Figure 12:
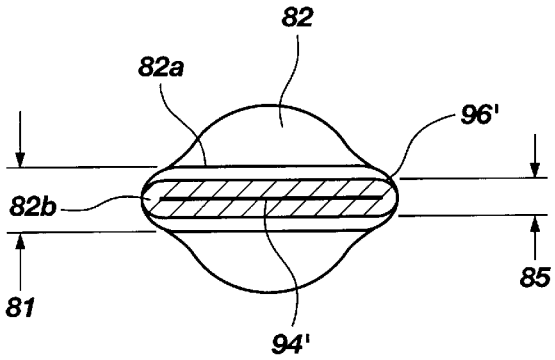
FIG. 12 shows a cross-sectional view through the fused portion of the top of the highway delineator of FIG. 7 taken along line C—C.

FIG. 12 shows a cross-sectional view of the fused portion 83 of the delineator of FIG. 7 taken along line C—C after the tube has been mechanically flattened and fused. In this view the inside surface 94' of the tube 82*b* is entirely collapsed upon itself, such that every portion of the inside surface 94' of the tube is in contact and fused with the opposing portion of that surface. The length of the line of contact 94' will be approximately equal to half the circumference of the inside surface 94 of FIG. 10. The present invention anticipates a complete and watertight bond along the line of contact 94'. The flattening and fusing process results in a thickness 85 of the fused section 83 that is less than the thickness 81 of the rest of the flattened portion 84. The outside surface 96 of the tube 82 of FIG. 9 becomes mostly comprised of two substantially parallel faces 96' in FIG. 10. Reflective markers 28 may be attached to either or both of the substantially parallel outside surfaces 96' of the delineator. The outside surfaces of the circular portion 82 and the flattened portion 82*a* of the tube are visible beyond the section of FIG. 12.

Figure 13:
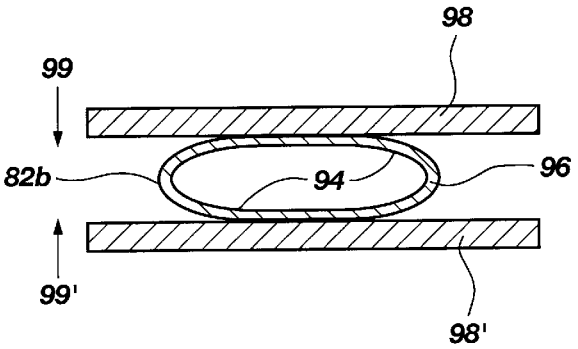
FIG. 13 shows a cross-sectional view near the top of the highway delineator of FIG. 7 taken along line C—C prior to the two sides of the tube being fused together.

FIG. 13 illustrates one method of developing the desired integral contact of the opposing internal faces 94 and shows a cross-sectional view in the topmost portion of the highway delineator of FIG. 7 taken along line C—C prior to the two sides of the tube being fused together. The tube 82*b* is placed between metal plates, 98 and 98', which contact the outside surface 96 of the tube, and collapse the tube in opposing directions, 99 and 99', squeezing and flattening the tube until the opposing inside surfaces 94 come into direct contact.

In the preferred embodiment, this integral contact is secured or fused together by means of vibro-welding. In this process the metal plates 98 and 98' vibrate the opposing sides of the tube in such a way as to generate sufficient heat through friction at the interface between the opposing sides 94 to mechanically fuse them together into a solid mass. In another embodiment of the present invention, a bonding agent suitable for use with the type of material of which the tube is composed is applied to the inside surface 94 of the tube 82 prior to mechanical flattening, then the metal plates or similar structure are used to flatten the tube and clamp it in the flat configuration for a sufficient time for the bonding agent to seal the tube together. In yet another embodiment of the present invention, the inside surfaces 94 are fused together by means of the direct application of heat to the top portion of the delineator. It will be apparent that other bonding processes may be implemented to accomplish the desired seal at the interior surfaces 94 of the upper tube end. Those skilled in the art will appreciate that the embodiments illustrated in the previous description are merely exemplary, and are not to be considered as limiting, except as set forth in the following claims.

What is claimed is:

1. A delineator device for use along roadways, underground utility lines and other surface areas requiring visual marking, said device comprising:

an elongate, resilient, polymer tube having a top end, a bottom end, an inside surface, and an outside surface;

the outside surface of the top end including an elongated, generally flat reflector portion configured to remain generally flat when the tube is impacted, the generally flat reflector portion having a length from the top end greater than a width of the tube;

a reflective material, secured to the outside surface of the reflector portion, configured to remain generally flat with the reflector portion when the tube is impacted;

the top end of the tube having a flattened cross-section with opposing inside surfaces sealed together to maintain the reflector portion and reflective material in a generally flat configuration, and to fully close the top end of the tube to prevent entrance of moisture or debris into the tube, and having a length from the top end of the tube of approximately 1.5 inches;

an opening in the tube to vent the tube to the atmosphere to equalize pressure within the tube with pressure outside the tube, such that the tube is configured to retain the reflector portion and reflector material in the generally flat configuration without deflecting during impact to maintain the reflective material secured to the reflector portion; and means for coupling the bottom end of the tube to the surface area to support the tube in an upright configuration for visual perception.

2. The device of claim 1, wherein the reflective material is further secured to flattened cross-section at the too end of the tube, such that the reflective material is disposed or both the generally flat reflector portion and the flattened cross-section.

3. The device of claim 1, wherein at least a portion of the generally flat reflector portion is formed by the flattened cross-section at the top end of the tube, such that th: reflector material is disposed on both the generally flat reflector portion and the flattened cross-section.

4. The device of claim 1, wherein the generally flat reflector portion has a thickness, and wherein the flattened cross-section has a thickness less than the thickness of the generally flat reflector portion.

5. The device of claim 1, wherein the tube is made of polypropylene.

6. The device of claim 1, wherein the tube is made of polyvinylchloride.

7. The device of claim 1, wherein the tube is made of polyethylene.

8. A delineator device for use along roadways, underground utility lines and other surface areas requiring visual marking, said device comprising;

an elongate, resilient, polymer tube having a top end, a bottom end, an inside surface, an outside surface, a width and at least three different sections with different cross-sections including:

(i) an elongated lower section, configured to be coupled to the surface area, with a circular cross-section configured to deflect under impact;

(ii) an elongated intermediate section, proximate the lower section and located near the top end of the tube, with a cro-s-section having an elongate gap extending between the opposing inside surfaces, said outside surfaces alone the gap being slightly arcuate to provide a flattened surface configured to increase visibility, the intermediate section having a length from the top end of the tube which is greater than the width of the tube, the intermediate section further having a width greater than the width of the tube; and (iii) a short too section, proximate the intermediate section at the top end of the tube, with a cross-section flattered together with opposing inside surfaces sealed together to maintain the slightly arcuate outer surface of the intermediate section, and to fully close the top end of the tube to prevent entrance of moisture or debris into the tube, the top section having a length from the top end of the tube which is less than the width of the tube;

a reflective material, secured to at least one of the slightly arcuate outer surfaces of the intermediate section;

a hole, formed in the tube, to vent the tube to the atmosphere to equalize pressure within the tube with pressure outside the tube, such that the lower section of the tube is configured to displace air within the tube out of the hole during impact without substantially compressing the air, such that the outside surfaces of the intermediate cross section of the tube are configured to retain the slightly arcuate configuration without substantially deflecting during impact to maintain the reflective material secured to the at least one of the outside surfaces; and means for coupling the lower section of the tube to the surface area to support the tube in an upright configuration for visual perception.

9. The device of claim 8, wherein the top section has opposite outside surfaces in parallel relationship, and wherein the reflective material is further secured to at least one of the outside surfaces of the top section such that the reflective material is disposed on the outer surfaces of both the top and intermediate sections.

10. The device of claim 8, wherein the reflective material is disposed on both the top and intermediate sections.

11. The device of claim 8, wherein the length of the top section is approximately 1.5 inches.

12. The device of claim 8, wherein the intermediate section has a thickness, and wherein the ton section has a thickness less than the thickness of the intermediate section.

13. The device of claim 8, wherein the tube is made of polypropylene.

14. The device of claim 8, herein the tube is made of polyvinylchloride.

15. The device of claim 8, wherein the tube is made of polyethylene.

16. A method of manufacture of a highway delineator, comprising the steps of:

(a) cutting an elongate, polymer tube to a length appropriate to form a highway delineator having a top one, a bottom end, an inside surface, and an outside surface;

(b) deforming the top end of the tube to include at least three different cross-sections including:

(i) a top section having a flattened cross-section with opposing inside surfaces sealed together to fully close the top end of the tube;

(ii) an elongated intermediate section, proximate the top section, having a generally flat cross-section maintained by the flattened cross-section of the top section, and with an elongate gap extending between the opposing inside surfaces, the outside surfaces along the gap being slightly arcuate to provide a flattened surface configured to remain flattened during impact; and (iii) a lower section, proximate the intermediate section, having circular cross-section;

(c) applying a reflective material to the flattened surface of the intermediate sect-on;

(d) forming a hole in te tube to equalize pressure within the tube with pressure outside the tube during impact to maintain the intermediate section in a generally flat configuration during impact; and (e) applying means for coupling the bottom end of the tube to the surface area to support the tube in an upright configuration for visual perception.

17. The method of claim 16, wherein step (c) further includes applying the reflective material to the top section.

18. The method of claim 16, wherein the intermediate section has a thickness, and wherein the top section has a thickness less than the thickness of the intermediate section.

19. A delineator device for use along roadways, underground utility lines and other surface areas requiring visual marking, said device comprising:

an elongate, resilient, polymer tube having a top end, a bottom end, an inside surface, and an outside surface;

the outside surface of the top end including an elongated, generally flat reflector portion configured to remain generally flat when the tube is impacted, the generally flat reflector portion having a length from the top end greater than a width of the tube, and a thickness;

a reflective material, secured to the outside surface of the reflector portion, configured to remain generally flat with the reflector portion when the tube is impacted;

the top end of the tube having a flattened cross-section with opposing inside surfaces sealed together to maintain the reflector portion and reflective material in a generally flat configuration, and to fully close the top end of the tube to prevent entrance of moisture or debris into the tube, and having a thickness less than the thickness of the generally flat reflector portion;

an opening in the tube to vent the tube to the atmosphere to equalize pressure within the tube with pressure outside the tube, such that the tube is configured to retain the reflector portion and reflector material in the generally flat configuration without deflecting during impact to maintain the reflective material secured to the reflector portion; and means for coupling the bottom end of the tube to the surface area to support the tube in an upright configuration for visual perception.

20. The device of claim 19, wherein the reflective material is further secured to flattened cross-section at the top end of the tube, such that the reflective material is disposed on both the generally flat reflector portion and the flattened cross-section.

21. The device of claim 19, wherein at least a portion of the generally flat reflector portion is formed by the flattened cross-section at the top end of the tube, such that the reflector material is disposed on both the generally flat reflector portion and the flattened cross-section.

22. The device of claim 19, wherein the flattened cross-section with opposing inside surfaces sealed together has a length from the top end of the tube between approximately ½ to 12 inches.

23. The device of claim 19, wherein the flattened cross-section with opposing inside surfaces sealed together has a length from the top end of the tube of approximately 1.5 inches.

24. The device of claim 19, wherein the tube is made of polypropylene.

25. The device of claim 19, wherein the tube is made of polyvinylchloride.

26. The device of claim 19, wherein the tube is made of polyethylene.

* * * * *